US012318835B2

(12) United States Patent
Hell

(10) Patent No.: US 12,318,835 B2
(45) Date of Patent: Jun. 3, 2025

(54) SEAMING DEVICE FOR SEALING A CONTAINER

(71) Applicant: Ferrum Packaging AG, Schafisheim (CH)

(72) Inventor: Günter Hell, Zetzwil (CH)

(73) Assignee: Ferrum Packaging AG, Schafisheim (CH)

( * ) Notice: Subject to any disclaimer, the term of this patent is extended or adjusted under 35 U.S.C. 154(b) by 188 days.

(21) Appl. No.: 17/795,837

(22) PCT Filed: Mar. 2, 2020

(86) PCT No.: PCT/EP2020/055461

§ 371 (c)(1),
(2) Date: Jul. 27, 2022

(87) PCT Pub. No.: WO2021/175407

PCT Pub. Date: Sep. 10, 2021

(65) Prior Publication Data

US 2023/0068764 A1 Mar. 2, 2023

(51) Int. Cl.
*B21D 51/32* (2006.01)
*B21D 51/26* (2006.01)

(52) U.S. Cl.
CPC ..... *B21D 51/32* (2013.01); *B21D 51/2653* (2013.01)

(58) Field of Classification Search
CPC ..... B21D 51/30; B21D 51/32; B21D 51/2653
See application file for complete search history.

(56) References Cited

U.S. PATENT DOCUMENTS

| | | | | |
|---|---|---|---|---|
| 1,819,249 A | | 8/1931 | Lange | |
| 1,819,250 A | | 8/1931 | Lange | |
| 2,150,002 A | * | 3/1939 | Link | B21D 51/32 413/5 |
| 2,993,457 A | * | 7/1961 | Geeson | B21D 51/32 413/32 |

FOREIGN PATENT DOCUMENTS

| | | | |
|---|---|---|---|
| CN | 202283573 | U | 6/2012 |
| CN | 103192001 | A | 7/2013 |
| CN | 110216181 | A | 9/2019 |
| DE | 102019009856 | A1 | 3/2019 |

* cited by examiner

*Primary Examiner* — Debra M Sullivan
(74) *Attorney, Agent, or Firm* — Global IP Counselors, LLP

(57) ABSTRACT

A seaming device includes a seaming head for fixing the lid to the container, first and second seaming rollers and a rotary drive. The seaming head is arranged between the first and second seaming rollers such that the container with the lid is fixed centered between the first and second seaming rollers in the operating state. The rotary drive is drive-connected to the first and second seaming rollers, the first and second seaming rollers rotated about the seaming head by the rotary drive, so that, in the operating state, the first and second seaming rollers are moved along a circumference of the container immovably fixed by the seaming head, and a container flange of the container are seamed with a lid flange of the lid.

17 Claims, 3 Drawing Sheets

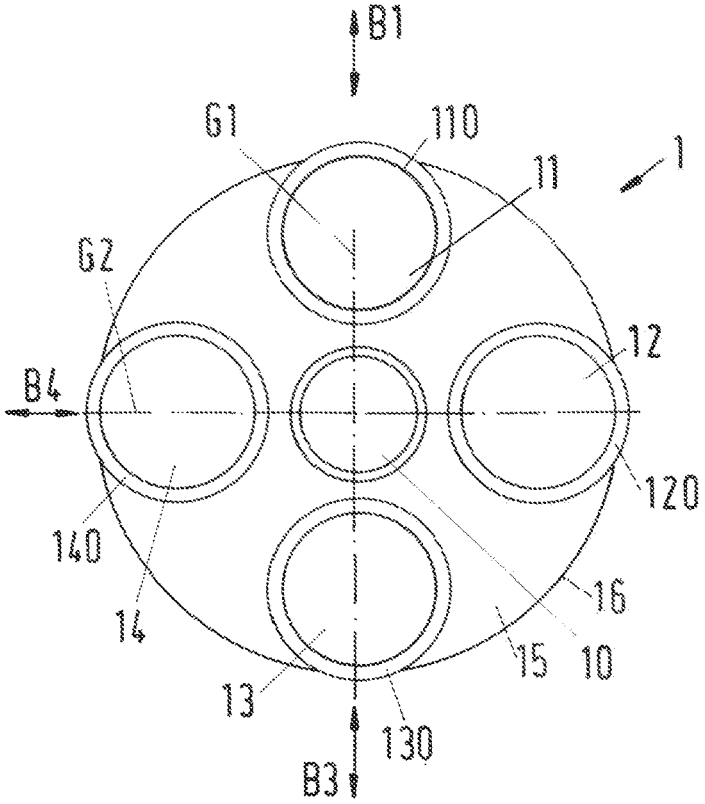
Fig.3A
Fig. 3B
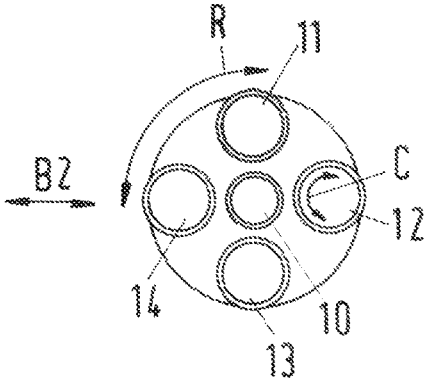
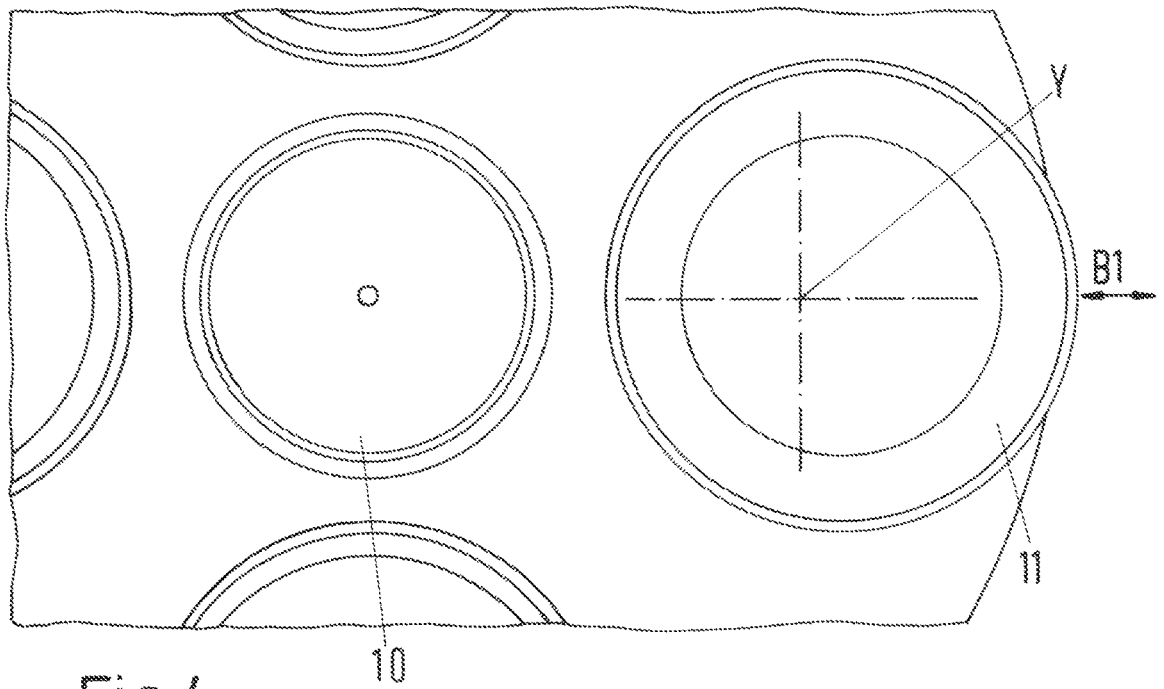
Fig.4

SEAMING DEVICE FOR SEALING A CONTAINER

CROSS-REFERENCE TO RELATED APPLICATION

This is application is a U.S. National Stage application of International Application No. PCT/EP2020/055461, filed Mar. 2, 2020, the contents of which is hereby incorporated by reference.

BACKGROUND

Field of the Invention

The disclosure relates to a seaming device for sealing a container by a lid. The disclosure further relates to a sealer having a seaming device and to a method for sealing the container by the lid.

Background Information

During the filling of beverage cans or food cans, the cans pass through a can sealer after being filled with the beverage or food, whereby the filled can bodies enter via a feed path and can lids enter via a further feed path. A conventional can sealer usually has several similar stations arranged in a carousel shape, in each of which a can is sealed by a can lid, wherein the stations are usually of rotary design, arranged in the form of an upright shaft. The can lids are guided onto the can bodies and held on the can body with a holding plate of a seaming head. This holding also serves to fix the cans against breaking out of the circular path through which the cans pass in the can sealer due to centrifugal force. In the can sealer, the can bodies with the can lid are seamed over a seaming roller at the edges and thus sealed. Normally, the can with the can lid is additionally rotated around its own axis of symmetry by the seaming head.

A conventional can sealer is described in DE 749636 and DE 4234115 A1. The can sealer comprises a clamping device for receiving a can to be sealed. In the operating state, the can to be sealed is introduced into the clamping device and secured by it in axial and radial direction. A can lid is also introduced centered over the can opening of the can to be sealed. The can has a circumferential can flange in the area of the can opening and the can lid has a circumferential can lid flange. For sealing the can opening by the can lid, the can sealer additionally comprises two seaming rollers, each mounted rotatably about an axis, which press the can flange and the can lid flange together by a force acting substantially radially, the pressing being effected by a continuous rolling in the circumferential direction along the circumference of the can opening by rotating the can.

A further conventional can sealer is disclosed in GB 2098899 A. The can sealer comprises a clamping device for receiving the can to be sealed and a seaming roller. In the operating state, the can to be sealed is introduced into the clamping device and secured by it in axial and radial direction. A can lid is also introduced centered over the can opening of the can to be sealed. The can has a circumferential can flange in the area of the can opening of the can body and the can lid has a circumferential can lid flange. For sealing the can opening by the can lid, the can sealer comprises a seaming roller mounted rotatably about an axis, which presses the can flange and the can lid flange together, the pressing being effected by a continuous rolling in the circumferential direction along the circumference of the can opening by rotating the can around its own axis.

SUMMARY

To explain this sealing module, reference is made in the following to FIG. 6, on the basis of which the previously described state of the art is described in more detail. To distinguish the state of the art from the present disclosure, the reference signs referring to features of conventional examples of the device are designated with an inverted comma, whereas features of embodiments according to the disclosure are designated with reference signs without an inverted comma.

FIG. 6 shows a sectional representation of a conventional can sealer 1' with a can 100' to be sealed and a can lid 101'.

According to FIG. 6, the conventional sealing module 1' comprises a clamping device, which comprises a can support 22' and a seaming head 10', and a seaming roller 11' with a seaming roller profile, mounted rotatably around a bolt. The can lid 101' is arranged centered over the opening of the can 100'. The can 100' has a circumferential can flange in the area of the can opening and the can lid 101' has a circumferential can lid flange.

During the sealing process, the seaming roller 11' is brought into contact with the can flange and the can lid flange via the seaming roller profile. In doing so, the can flange and the can lid flange are pressed together by a force acting substantially radially via the seaming roller 11'. The pressing is effected by a continuous rolling of the seaming roller 11' in the circumferential direction along the circumference of the can opening, for which purpose the can 100' is rotated around the axis X' by the seaming head 10' and the can support 22'. By seaming the can 100' with the can lid 101', a double seam is preferably created.

The seaming roller 11' for sealing a can 100' disclosed in GB 2098899 A consists of the bolt and a rotatable rotation body 11', which attaches to the can 100' with the seaming profile. The rotation body 11' is cylindrical and has a first, round base side and a second, round base side opposite the first round base side. A bearing for receiving the bolt is located inside the seaming roller 11', wherein the bolt is supported by the first base side in the bearing. Thus, the rotation body 11' can rotate around the bolt in the circumferential direction of the second base side when sealing the can 100'. Here, the seaming profile is brought into contact with the can lid 101' and the can 100' is then rotated along its can axis X' in order to seal it.

For this purpose, the can 100' is lifted from below in the operating state and guided to the seaming head 10', where the can is axially secured and rotated by the seaming head 10'.

It has been determined that a substantial disadvantage of the conventional devices in the state of the art is that they are not very flexible, in particular defined spacings are required and the containers must be moved during the sealing process. In addition, the conventional devices in the state of the art cannot be freely parameterized due to the mechanical coupling of all movements and the infeed movements must be very precise over a very large range.

It is therefore an object of the present disclosure to provide a seaming device and a method for sealing a container which avoids the adverse effects known from the conventional devices in the state of the art. In particular, a flexible seaming device is to be provided, by which both different container formats can be processed and the problem of spacing can be prevented when transferring between different processing stations.

The object is met by a seaming device according to an embodiment of the invention, by a method for sealing a container and by a sealer comprising the seaming device.

According to the disclosure, an embodiment is directed to a seaming device for sealing a container by a corresponding lid comprising a seaming head for fixing the lid to the container and a first seaming roller with a first seaming profile and a second seaming roller with a second seaming profile. The seaming head is arranged between the first seaming roller and the second seaming roller in such a way that the container with the lid can be fixed centered between the first seaming roller and the second seaming roller in the operating state. The embodiment is characterized in that the seaming device comprises a rotary drive drive-connected to the first seaming roller and the second seaming roller, wherein the first seaming roller and the second seaming roller can be rotated about the seaming head by the rotary drive, so that, in the operating state, the first seaming roller and the second seaming roller with the first seaming profile and the second seaming profile can be moved along a circumference of the container immovably fixed by the seaming head, wherein a container flange of the container can be seamed with a lid flange of the lid. This means that the first seaming roller and the second seaming roller rotate around the container in the operating state, while the container does not move.

Within the framework of embodiments of the invention, a rotary drive can be understood as a drive which is suitable for setting a part in rotation. However, the rotary drive does not have to rotate itself for this. Here, drive-connected means that the seaming rollers are connected to the rotary drive in the operating state in such a way that they can be set in rotation by the drive. In a special embodiment, the seaming head can be arranged centered or centerably (if movable seaming rollers are present) between the first seaming roller and the second seaming roller. The fact that the container with the lid can be fixed centered (or centerably) between the first seaming roller and the second seaming roller or a large number of seaming rollers in the operating state means that the container with the lid is arranged between (at least) two seaming rollers (e.g. the first and second) during seaming, which simultaneously exert a force for seaming, so that it is simultaneously seamed by (at least) two seaming rollers (i.e. the seaming rollers can be moved simultaneously along a circumference of the container immovably fixed by the seaming head). In this way, a symmetrical application of force by the seaming rollers on the container can be ensured at least in part.

According to the disclosure, a method for seaming the container with the corresponding lid is further proposed. Here, the method according to an embodiment of the invention comprises the following steps:

a) Providing the seaming device according to the disclosure;
b) Introducing the container and the lid into the seaming device according to the disclosure;
c) Applying the lid to an opening of the container;
d) Immovably fixing of the container and the lid by the seaming head centered between the first seaming roller and the second seaming roller;
e) Rotating the first seaming roller and the second seaming roller about the seaming head, so that the first seaming roller and the second seaming roller with the first seaming profile and the second seaming profile are moved along the circumference of the container, the container flange of the container being seamed with the lid flange of the lid.

Due to the seaming device, not only the area where precise infeeds have to be made is minimized, but also an autonomous seaming device is provided, which dispenses with the mechanical couplings known from the state of the art.

The container can be a can and the lid can be a can lid, whereby a sealer is then correspondingly designed as a can sealer. To seal the container, the seaming rollers are brought into contact with the lid flange and the container flange with their seaming profile in the operating state. By rotating the seaming rollers around the seaming head and thus around the container, the seaming rollers are rotated around the container in the circumferential direction of the container, whereby the lid flange is seamed with the container flange. It is decisive here that the container is fixed during sealing, i.e. that it does not move and in particular does not rotate, as is the case with the devices known from the state of the art.

Within the framework of the disclosure, the can can be understood to be a rotationally symmetrical container which is sealed by the can sealer and the associated seaming rollers. A can can preferably comprise a metal, in particular aluminum. However, the container need not be rotationally symmetrical. It is in particular sufficient if the container flange is rotationally symmetrical.

The first seaming roller and the second seaming roller can be rotatable about a seaming head axis of the seaming head, in which seaming head axis the container is arranged with its container axis in the operating state.

In practice, the first seaming roller and the second seaming roller can be arranged on a seaming roller arrangement, whereby the rotary drive comprises a seaming drive drive-connected to the seaming roller arrangement, by which seaming drive the seaming roller arrangement can be rotated at a first angular speed so that, in the operating state, the first seaming roller and the second seaming roller with the first seaming profile and the second seaming profile can be moved along the circumference of the container immovably fixed by the seaming head. In this case, the seaming rollers can be arranged rotatably on the seaming roller arrangement, so that the seaming rollers, when they are in a force-locked contact with the container in the operating state, are moved along their respective seaming profile on the circumference of the container and thus rotate about their own axis. In a particularly preferred embodiment, the seaming drive can be designed as a first servo drive.

In addition, the seaming roller arrangement can be arranged around the seaming head and an axis of rotation of the seaming roller arrangement can correspond to the seaming head axis of the seaming head. With this embodiment, the seaming roller arrangement can preferably be ring-shaped and arranged around a round seaming head. The seaming head axis also preferably corresponds to an axis of symmetry of the container around which the seaming rollers rotate in the operating state.

Furthermore, the rotary drive can comprise a seaming roller drive drive-connected to the first seaming roller and/or the second seaming roller, and the first seaming roller can be rotatable along the first seaming profile by the seaming roller drive in the operating state and/or the second seaming roller can be rotatable along the second seaming profile by the seaming roller drive in the operating state, so that, in the operating state, the first seaming roller and the second seaming roller with the first seaming profile and the second seaming profile can be moved along the circumference of the container immovably fixed by the seaming head. The rotary drive can comprise both the seaming drive and the seaming roller drive. The seaming roller drive can be designed in particular as a second servo drive. Preferably, the first seaming roller rotates along the first seaming profile and the second seaming roller along the second seaming profile, wherein the first seaming roller and the second seaming roller rotate synchronously and at a fixed angular distance from each other. If the seaming rollers are arranged on the seaming roller arrangement, the seaming roller drive can also be regarded as a seaming drive, since the seaming roller arrangement is also moved by the rotation of the seaming rollers.

In a particularly preferred embodiment, the seaming device comprises a seaming roller with a third seaming profile and a fourth seaming roller with a fourth seaming profile for seaming a container flange of the container with a lid flange of the lid. The seaming head is arranged, in particular centerably arranged, between the third seaming roller and the fourth seaming roller (and also between the first seaming roller and the second seaming roller) in such a way, that the container with the lid can be fixed centered between the third seaming roller and the fourth seaming roller in the operating state, and the third seaming roller and the fourth seaming roller is drive-connected to the rotary drive, wherein the third seaming roller and the fourth seaming roller can be rotated about the seaming head by the rotary drive, so that, in the operating state, the third seaming roller and the fourth seaming roller with the third seaming profile and the fourth seaming profile can be moved along the circumference of the container immovably fixed by the seaming head, wherein the container flange of the container can be seamed with the lid flange of the lid.

The third seaming roller and the fourth seaming roller can also be rotated preferably around the seaming head axis of the seaming head, in which seaming head axis the container is arranged with its container axis in the operating state. Furthermore, the third seaming roller and the fourth seaming roller can be arranged analogously with the first and second seaming roller on the seaming roller arrangement and can be rotatable at the first angular speed by the seaming drive with the seaming roller arrangement, so that the third seaming roller and the fourth seaming roller with the third seaming profile and the fourth seaming profile can be moved in the operating state along the circumference of the container immovably fixed by the seaming head.

In addition, the rotary drive can preferably comprise the seaming roller drive drive-connected to the third seaming roller and/or the fourth seaming roller, wherein the third seaming roller can be rotated along the third seaming profile by the seaming roller drive in the operating state and/or the fourth seaming roller can be rotated along the fourth seaming profile by the seaming roller drive in the operating state, so that, in the operating state, the third seaming roller and the fourth seaming roller with the third seaming profile and the fourth seaming profile can be moved along the circumference of the container immovably fixed by the seaming head.

Furthermore, the third and the fourth seaming rollers can be rotatable synchronously and at a fixed angular distance from each other and from the first and second seaming roller.

In practice, the seaming device according to embodiments of the invention can comprise a large number of seaming rollers. Of course, any desired number can be used. Particularly preferred, the seaming device can comprise two, three, four or five seaming rollers in this case. The previously described measures for the first, second, third and also fourth seaming roller can of course be applied to further seaming rollers of the seaming device. Within the framework of the application, "seaming rollers" will be used as a synonym for any desired number of seaming rollers, unless specified otherwise. In practice, it is particularly preferred if each seaming roller is connected to its own seaming roller drive, which is in particular designed as a servo drive so that the seaming rollers can rotate along their seaming profile.

In a very important embodiment, the seaming device comprises four seaming rollers, which are arranged in the form of a rectangle, especially in the form of a square around the seaming head (i.e. symmetrically at equal distances around the seaming head). The first seaming roller can be arranged with the seaming head and the third seaming roller on a first straight line (on opposite sides of the seaming head) and the second seaming roller can be arranged with the seaming head and the fourth seaming roller on a second straight line (on opposite sides of the seaming head). Especially, the first and second straight lines can be orthogonal to each other.

The seaming device can comprise a moving device connected to the first and/or third seaming roller and to the second and/or fourth seaming roller, by which moving device the first and/or third seaming roller can be displaced along the first straight line and the third and/or fourth seaming roller can be displaced along the second straight line, thus enabling an adaptation to different seaming dimensions, such as on containers of different sizes because the seaming rollers can be moved in the direction of the seaming head or away from it. The first and third seaming rollers preferably have an identical seaming profile, and the second and fourth seaming rollers also preferably have an identical seaming profile that is different from that of the first and third seaming rollers. In the operating state, the first and third seaming rollers approach the center (seaming head/container) in an identical infeed movement as the first operation, and the second and fourth seaming rollers approach the center (seaming head/container) in an identical infeed movement as the second operation. Due to the symmetrical arrangement of the seaming rollers, the forces acting on the seaming head cancel each other out. In addition, significantly less time is needed to seal the container, since fewer rotary movements are required to seal the container due to the large number of seaming rollers arranged opposite each other.

In principle, each seaming roller can be drive-connected to its respective seaming roller drive via a respective shaft connection. A respective shaft connection can comprise an eccentric connection so that the respective seaming roller is arranged eccentrically to an axis of rotation of the seaming roller drive. Preferably, all shaft connections of the seaming rollers comprise an eccentric connection (also eccentric axis connection).

If the seaming rollers are connected to a seaming roller carrier part such as the seaming roller arrangement or the seaming roller drive by the eccentric connection, an adjustment of a gap distance of the seaming rollers can be enabled by adjusting the eccentric connection (movement device), thus enabling an adaptation to different seaming dimensions, such as containers of different sizes.

For this purpose, for example, a worm screw can be turned, and the eccentricity of the eccentric connection allows an adjustment radially towards or away from the container axis/seaming head axis. This movement reduces or increases the distance between the seaming rollers, or the distance from the seaming head (gap distance).

In an embodiment of the invention, the seaming head can comprise a gas supply for supplying a gas, in particular an inert gas, to the container. In addition, the seaming head can comprise a suction device for sucking the lid, whereby the lid can be sucked and placed on an opening of the container.

In this context, embodiments of the invention further comprise a hollow shaft for a seaming device, in particular a seaming device according to the disclosure, wherein the hollow shaft comprises a first end for fastening a seaming head and comprises a second end arranged opposite the first end, which second end is connected to a feeding device. The first end is flow-connected to the second end by a recess (a cavity/a channel/a pipe) inside the hollow shaft. As a result, a vacuum can be applied to the seaming head by the feeding device via the recess in the hollow shaft and/or a liquid/a gas can be discharged from the seaming head. If the hollow shaft is integrated in the seaming device according to the invention, it is arranged as a seaming head shaft for fastening the seaming head to the seaming device.

According to the disclosure, a sealer comprising the seaming device according to the disclosure for sealing the container is further proposed.

The sealer according to the disclosure can comprise a container feed. The container feed can be designed as a conveyor belt. Due to the arrangement according to the invention, a clamping of the container (as guaranteed in the state of the art by a spring assembly and seaming head) can be dispensed with. The seaming device according to the disclosure can simply move up to the container to be sealed and seal the container completely autonomously, since the seaming device can be arranged movably due to the absence of mechanical couplings. For this purpose, the seaming device preferably comprises an autonomous movement mechanism that can move the seaming device flexibly in all spatial directions. In particular, due to the free movability of the seaming device according to the invention, the container can easily be touched/approached from above. Since the container does not rotate about its axis during the sealing process, the container can even be sealed while moving on the conveyor belt, whereby the seaming device according to the disclosure follows the movement of the conveyor belt. For this purpose, the seaming device can preferably comprise a detector system, in particular a camera system for locating a container position of the container. Containers can therefore be sealed on any surface by the seaming device according to the disclosure.

The camera system for locating a container position of the container can also be used to align the lid on the container. For this purpose, the container can comprise an orientation means on at least one container part. A targeted alignment of the lid on a container opening takes place with respect to the orientation means. Subsequently, the aligned lid is applied to the container opening. The orientation means could be a label on the container, whereby the lid is aligned in such a way that the label/orientation means is visible when the container is in a drinking orientation. The alignment of the lid can be achieved by arranging the seaming head rotatably around the seaming head axis, so that the lid can be aligned by rotating the seaming head.

In principle, the sealer can also comprise at least two seaming rollers, preferably with different seaming profiles, so that containers can be sealed according to a double-seam principle in which the containers are generally sealed in two stages. One seaming roller is responsible for each step. One seaming roller makes a pre-seam, while the second seaming roller completely seals the container with the finishing seam. In particular, the first seaming roller and the third seaming roller can be designed as pre-seaming rollers to form the pre-seam, and the second seaming roller and the fourth seaming roller can be designed as finishing seaming rollers to form the finishing seam. When sealing the container, first the first seaming roller and the third seaming roller can make contact to the container with their seaming profile by displacing towards the container, so that the first seaming roller and the third seaming roller can rotate around the container to form the pre-seam. Subsequently, the second seaming roller and the fourth seaming roller can make contact to the container with their seaming profile by displacing towards the container, so that the second seaming roller and the fourth seaming roller can rotate around the container to form the finishing seam. In addition, a sealing can be achieved according to the double-seam principle in which the seaming roller comprises a seaming profile that comprises a first area that makes the pre-seam and a second area that makes the finishing seam. As an alternative, a seaming roller could also comprise two different seaming profiles, which are arranged at two different positions of the seaming roller.

As a consequence, the pre-seam can be rolled up in a first work process, and in a second work process the pre-seam can be smoothed to the required tightness (finishing seam).

In a method according to an embodiment of the invention, before the container and the lid are introduced into the seaming device according to the disclosure, a run-out correction of the seaming rollers can be carried out by moving (feeding) the seaming rollers up to the seaming head and rotating them around the seaming head. During this rotation around the seaming head, a run-out sensor (e.g. a distance sensor or a force sensor) can determine unevenness in the seaming head and/or the seaming roller and correct this unevenness when sealing the container by adapting the infeed (position of the seaming rollers in relation to the seaming head) of the seaming rollers to the seaming head.

In a particularly preferred embodiment, the container is clinched before seaming the cover flange with the container flange. In this process, the can flange is clinched with the container flange in such a way (also joining by shearing and upsetting: joining of metal sheets without using an additional material) by bending the lid flange around the container flange until the lid is fixed to the container, but the container is not yet sealed by the lid. Clinching can be achieved by the device according to the invention or by an upstream device. In particular, the container can be evacuated after clinching. Clinching is especially advantageous for powdery products.

In particular, the following advantages result from the device according to the invention. The containers do not have to enter the sealer at a defined spacing because the seaming device can be moved towards the containers. The container is fixed during sealing/seaming, i.e. it does not rotate during sealing, which is very advantageous e.g. for powder as filling material. No laborious format changes are necessary, as the seaming rollers can be movable (e.g. eccentric connection) and can therefore be adapted to different formats. No scaling is necessary in the sealer, as there are simply several seaming devices installed. The lids can be easily oriented on the container by the seaming head (since rotation of container and lid is not coupled via a gear). No spring assembly is necessary under the container, since the container does not have to be lifted. In addition, wear of the seaming head is not a problem because the seaming rollers can always be referenced to the seaming head and can therefore deliver a constant seam width.

In principle, the disclosure depicts the current seaming process mechatronically. The same seaming profiles are preferably used and the same "double seam" preferably results. In contrast to the present process, the container is standing, in particular the can and the seaming rollers rotate around the container.

In the case of embodiments of the invention, it is an autonomous seaming device which can be flexibly installed in a complete system. If more capacity is required, simply more seaming devices are installed in the system.

Since the container is only touched from above during sealing, it can run in on the conveyor belt, for example. The movement of the seaming device in all spatial directions, as well as the movement of the seaming rollers, in particular the rotation of seaming rollers and seaming roller arrangement, can be freely parameterized by using servo drives.

Forces can be measured during operation via sensor technology or power consumption of the servo drives, whereby quality control can also be carried out. The seaming does not have to be path-controlled but can be force-controlled by using force sensors on the seaming rollers. This means that an automatic adjustment can be made by measuring the force during seaming. The power can be transferred to the rotors (of the seaming rollers) by induction. In addition, signals can be transmitted by wireless technology to rotors.

The lid can be pneumatically sucked in and ejected by the suction device. A fully automatic format change can be performed at container height, as the seaming device is height-adjustable along the seaming head axis in order to ensure an infeed of the seaming head to the container in this way. In particular, an infeed of the seaming head in the axial direction (i.e. a height adjustment with respect to the seaming head axis) can also be force-controlled.

Particularly preferred, the infeed of the seaming rollers and/or the seaming head to the container can also be achieved by a combination of force control and path control, by feeding the seaming rollers and/or the seaming head to the container until a pre-determinable force is reached and then moving them further to the container over a pre-determinable distance (path).

The container can be gassed by the seaming head and, in particular, can also be filled by the seaming head and a corresponding feed line at the seaming head. For this purpose, the container is first gassed by the seaming head and only then the lid is applied to the container.

BRIEF DESCRIPTION OF THE DRAWINGS

The invention will be explained in more detailed hereinafter with reference to the drawings.

FIGS. 3A and 3B illustrate a schematic representation of a view onto a bottom side of the seaming device according to an embodiment of the invention;

FIG. 4 illustrates a section of the schematic representation according to FIGS. 3A and 3B;

DETAILED DESCRIPTION

Figure 1:
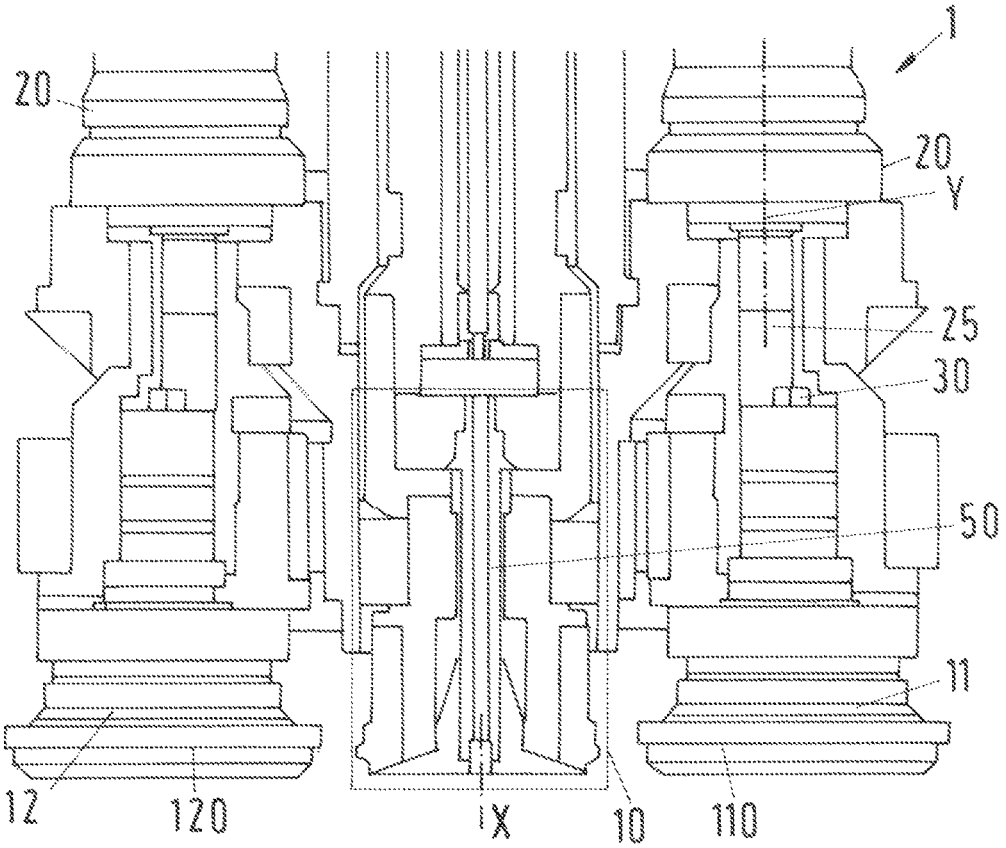
FIG. 1 illustrates a schematic representation of a seaming device according to an embodiment of the invention.

FIG. 1 shows a schematic representation of a seaming device 1 according to an embodiment of the invention.

The seaming device 1 comprises a seaming head 10 (which is arranged on the seaming device 1 by the hollow shaft 50) for fixing a lid to a container and a first seaming roller 11 with a first seaming profile 110 and a second seaming roller 12 with a second seaming profile 120.

The seaming head 10 is immovably arranged between the first seaming roller 11 and the second seaming roller 12. In the operating state, the container with the lid can be fixed by the seaming head 10 centered between the first seaming roller and the second seaming roller by arranging the container with its opening at the seaming head 10. The lid is preferably already arranged at the seaming head 10. For this purpose, the seaming head 10 comprises a suction device by which the seaming head 10 can be received, for example by generating a vacuum.

Figure 2:
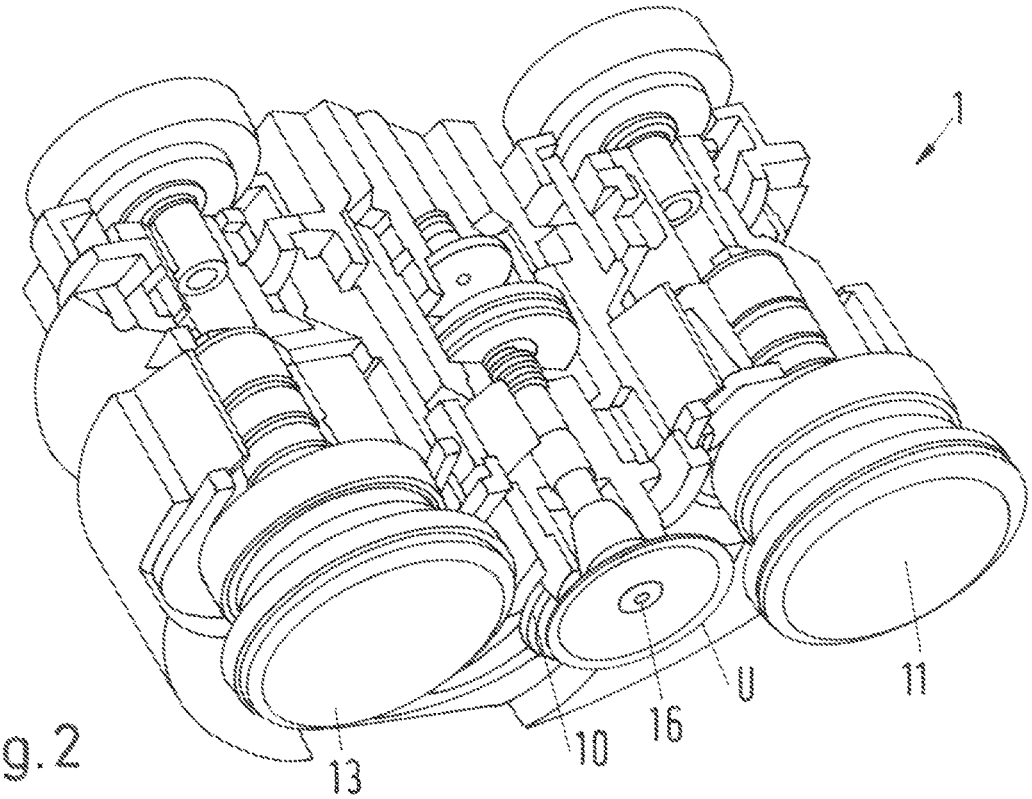
FIG. 2 illustrates a further representation of the seaming device according to an embodiment of the invention.

The seaming device 1 comprises a rotary drive 20 drive-connected to the first seaming roller 11 and the second seaming roller 12, wherein the first seaming roller 11 and the second seaming roller 12 can be rotated about the seaming head 10 by the rotary drive 20, so that, in the operating state, the first seaming roller 11 and the second seaming roller 12 with the first seaming profile 110 and the second seaming profile 120 can be moved along a circumference (not shown here; but corresponds to circumference U of the seaming head as shown in FIG. 2) of the container 100 immovably fixed by the seaming head 10, wherein a container flange of the container can be seamed with a lid flange of the lid.

To seal the container, first the lid is applied to the opening of the container by the seaming head 10, then the container and the lid are fixed centered between the first seaming roller 11 and the second seaming roller 12 by the seaming head 10. Subsequently, the first seaming roller 11 and the second seaming roller 12 are rotated about the seaming head 10, so that the first seaming roller 11 and the second seaming roller 12 with the first seaming profile 110 and the second seaming profile 120 are moved along a circumference of the container, wherein the container flange of the container is seamed with the lid flange of the lid.

In the case of the present embodiment, the first seaming roller 11 and the second seaming roller 12 can be rotated about a seaming head axis X of the seaming head, in which seaming head axis X the container with its container axis can be arranged in the operating state.

The rotary drive 20 is designed as a seaming roller drive 20 drive-connected to the first seaming roller 11 and the second seaming roller 12, and the first seaming roller 11 can be rotated along the first seaming profile 110 in the operating state by the seaming roller drive 20 and the second seaming roller 12 can be rotated along the second seaming profile 120 in the operating state by the seaming roller drive 20, so that the first seaming roller 11 with the first seaming profile and the second seaming roller 12 with the second seaming profile 120 can be moved along the circumference of the container which can be immovably fixed by the seaming head 10. The seaming roller drive 20 can be designed in particular as a servo drive 20. This means that the first seaming roller 11 and the second seaming roller 12 rotate along their respective seaming profiles, wherein the first seaming roller 11 and the second seaming roller 12 preferably rotate synchronously and at a fixed angular distance from each other.

Both seaming rollers 11, 12 are drive-connected to a respective seaming roller drive 20 via a respective shaft connection 25. This means that each seaming roller 11, 12 is connected to a separate seaming roller drive 20. The respective shaft connections 25 each comprise an eccentric connection 30, so that the respective seaming roller 11, 12 is arranged eccentrically to an axis of rotation Y of the seaming roller drive 20.

By adjusting the eccentric connection 30 (also movement device), an adjustment of a gap distance of the seaming rollers 11, 12 can be enabled, whereby an adaptation to different seaming dimensions, i.e. containers of different sizes, is enabled.

FIG. 2 shows a further representation of the seaming device 1 according to an embodiment of the invention.

The seaming device 1 comprises two seaming rollers 11, 13 arranged opposite each other. A third seaming roller 13 is arranged on the side of the seaming head 10 opposite the first seaming roller 11. The first seaming roller 11 and the third seaming roller 13 preferably have the same seaming profile. In the operating state, the first seaming roller 11 and the third seaming roller 13 move toward the center (the seaming head 10) in an identical infeed movement. Due to the symmetrical arrangement of the seaming rollers 11, 13, the forces acting on the seaming head 10 cancel each other out.

In addition, the seaming head 10 comprises a gas supply 16 for supplying a gas, in particular an inert gas, to the container. The gas supply 16 is designed as an opening 16 from which the gas can flow out.

In addition, the gas supply 16 can be used as a suction device 16 for sucking the lid, whereby the lid can be sucked and placed on an opening of the container by creating a negative pressure by the suction device 16. This means that the lid is pneumatically sucked in and ejected.

The gassing with the gas supply 16 could take place in a vacuum gas chamber, whereby the lid is first clinched, then evacuated via the gas supply 16, then gassed via the gas supply 16 and finally the container is completely sealed.

FIGS. 3A and 3B show a schematic representation of a view onto a bottom side of the seaming device 1 according to an embodiment of the invention.

The first seaming roller 11 and the third seaming roller 13 are arranged on a seaming roller arrangement 15, wherein the rotary drive can comprise a seaming drive drive-connected to the seaming roller arrangement 15, by which seaming drive the seaming roller arrangement 15 can be rotated at a first angular speed so that, in the operating state, the first seaming roller 11 and the second seaming roller 12 with the first seaming profile 110 and the second seaming profile 120 can be moved along the circumference of the container immovably fixed by the seaming head. However, each seaming roller preferably comprises its own seaming roller drive 20 according to FIG. 1.

The seaming device 1 further comprises a third seaming roller 13 with a third seaming profile 130 and a fourth seaming roller 14 with a fourth seaming profile 140 for seaming the container flange of the container with a lid flange of the lid. The seaming head 10 is arranged centered between the third seaming roller 13 and the fourth seaming roller 14 (and also between the first seaming roller 11 and the second seaming roller 12 in such a way, that the container with the lid can be fixed centered between the seaming rollers 11, 12, 13, 14 in the operating state.

The third seaming roller 13 and the fourth seaming roller 14 are also drive-connected to the rotary drive, wherein the third seaming roller 13 and the fourth seaming roller 14 can be rotated about the seaming head 10 by the rotary drive, so that, in the operating state, the third seaming roller 13 and the fourth seaming roller 14 with the third seaming profile 130 and the fourth seaming profile 140 can be moved along the circumference of the container immovably fixed by the seaming head 10, wherein the container flange of the container can be seamed with the lid flange of the lid.

In this case, the seaming rollers 11, 12, 13, 14 can be rotated along their respective seaming profile along the arrow C, preferably by their respective seaming roller drives. If the seaming rollers 11, 12, 13, 14 are in force-locked contact with the container in the operating state, they also rotate around the container due to the rotation along the arrow C. Here, the seaming roller arrangement 15 is therefore also set in rotation and rotates along the arrow R with the seaming rollers 11, 12, 13, 14 around the seaming head 10.

The seaming rollers 11, 12, 13, 14 rotate synchronously and at a fixed angular distance from each other. The seaming roller arrangement 10 is ring-shaped and arranged around the round seaming head 10.

According to FIGS. 3A and 3B, the seaming rollers 11, 12, 13, 14 with their seaming profile 110, 120, 130, 140 are brought into contact with the lid flange and the container flange in the operating state in order to seal the container. Due to the rotation of the seaming rollers 11, 12, 13, 14 around the seaming head 10 and thus around the container, the seaming rollers 11, 12, 13, 14 are rotated around the container in the circumferential direction of the container, whereby the lid flange is seamed to the container flange, since the seaming rollers exert a pressure on the lid flange and the container flange. Here, it is crucial that the container is fixed during sealing, i.e. that it does not move and in particular does not rotate, as is the case with the devices known from the state of the art.

The four seaming rollers 11, 12, 13, 14 are arranged in the form of a rectangle, in particular in the shape of a square. The first seaming roller 11 with the seaming head 10 and the third seaming roller 13 is arranged on a first straight line G1 and the second seaming roller 12 with the seaming head 10 and the fourth seaming roller 14 is arranged on a second straight line G2. The first straight line G1 and the second straight line G2 are orthogonal to each other.

The seaming device 1 comprises a movement device connected to the first and third seaming rollers 11, 13 and to the second and fourth seaming rollers 12, 14, by which movement device the first and/or third seaming roller can be displaced along the first straight line G1 (arrows B1 and B3), and the third and fourth seaming rollers can be displaced along the second straight line G2 (arrows B2 and B4), whereby an adaptation to different seaming dimensions, i.e. to containers of different sizes is enabled, and also an infeed of the seaming rollers 11, 12, 13, 14 to the seaming head 10 and thus to the container.

The infeed and movement of the seaming rollers preferably takes place via the eccentric connection and the seaming roller drive, which form the movement device. The arrangement according to FIGS. 3A and 3B is a preferred embodiment of the invention as a symmetrical application of force to the container is enabled. In addition, the container can be sealed particularly advantageously with a double seam, with the first and third seaming rollers producing a pre-seam and the second and fourth seaming rollers producing a finishing seam. Due to the symmetrical arrangement of the seaming rollers 11, 12, 13, 14, the forces acting on the seaming head 10 cancel each other out. In addition, considerably less time is needed to seal the container, since fewer rotational movements are required to seal the container due to the large number of seaming rollers 11, 12, 13, 14 arranged opposite each other.

FIG. 4 shows a section of the schematic representation according to FIGS. 3A and 3B.

According to FIG. 4, the first seaming roller (as well as all other seaming rollers) can be moved relative to the center of rotation of the infeed Y and thus moved along the arrow B1 towards the seaming roller 10 or away from the seaming roller 10.

To control the movement of the seaming rollers, the seaming rollers or the seaming device can comprise sensors. The sensors can measure forces during operation or a power consumption of the motors (seaming roller drive). In doing so, on the one hand, a quality control can be performed. On the other hand, a path control of the seaming can be performed, and particularly preferred, a force control of the seaming can be performed. For force control, a pre-determinable force can be adjusted by the seaming roller drives which the respective seaming roller should exert on the container. For this reason, the seaming roller drives are preferably designed as servo drives.

Figure 5:
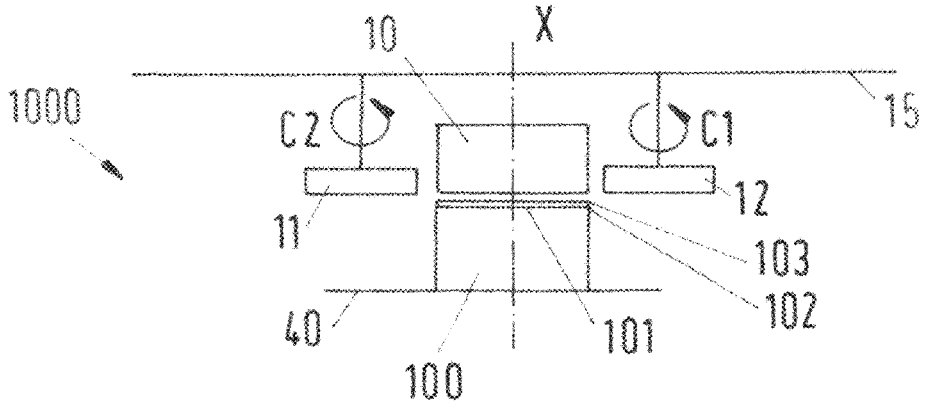
FIG. 5 illustrates a schematic representation of a further embodiment of the seaming device according to the invention.

FIG. 5 shows a schematic representation of a further embodiment of the seaming device 1 according to the invention in a sealer 1000 according to an embodiment of the invention.

The seaming device 1 comprises the first seaming roller 11 and the second seaming roller 12. The sealer 1000 comprises a container feed 40 which is preferably designed as a conveyor belt. The container 100 is guided under the seaming head 10 by the container feed 40. By moving the seaming head 10 along the axis X, the seaming head can be fed to the container 100 so that the container is immovably fixed, i.e. fixed in such a way that it does not rotate when being sealed by the seaming rollers 11, 12.

To seal the container with its lid 101, the lid 101 is applied to the opening of the container 100 by the seaming head 10. Then, the seaming rollers 11, 12 are fed to the container 100 as described above and rotated about their axis along the arrows C1 and C2. The seaming rollers 11, 12 are rotated with their seaming roller arrangement 15 around the seaming head 10 and around the container 100 by the rotation C1 and C2 and by the force-locked contact with the container 100.

Particularly preferred, the container 100 is a can 100 and the lid 101 a can lid 101.

Figure 6:
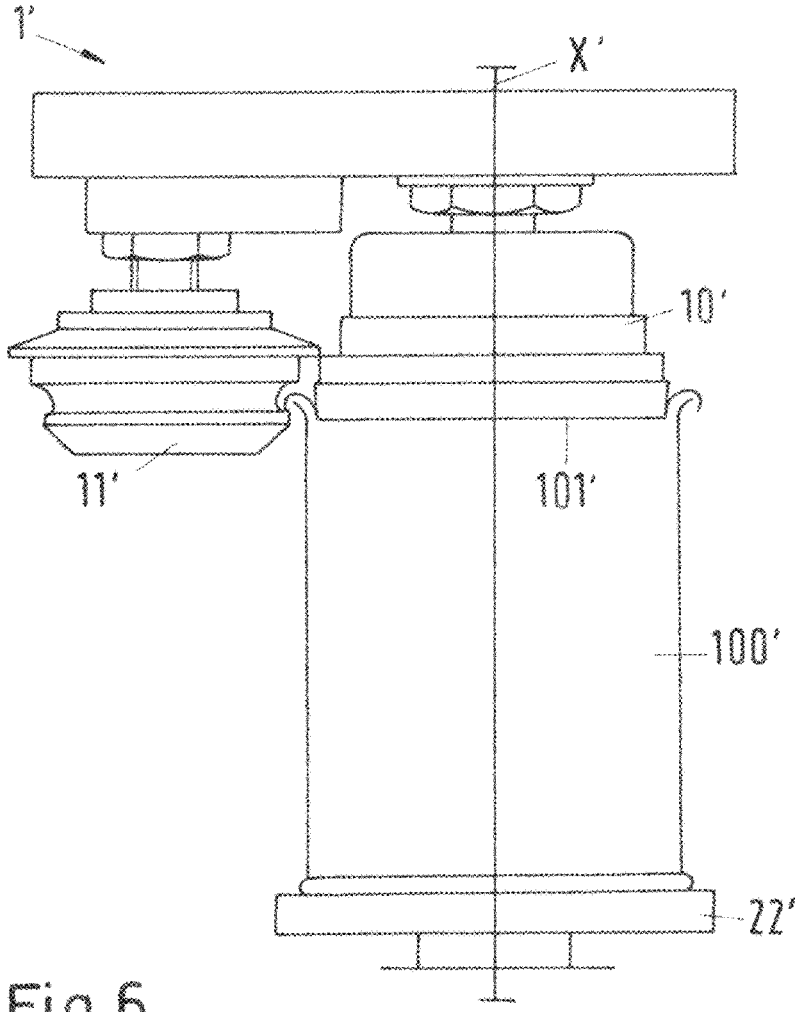
Fig.6 Prior Art
FIG. 6 illustrates a schematic representation of the state of the art.

FIG. 6 shows a schematic representation of the state of the art, which has already been described above. As already mentioned above, the reference signs of FIG. 6 have an inverted comma, since they refer to the known state of the art.

The invention claimed is:

1. A seaming device for sealing a container with a corresponding lid, comprising:

a seaming head configured to fix the lid to the container, a first seaming roller with a first seaming profile;

a second seaming roller with a second seaming profile, the seaming head arranged between the first seaming roller and the second seaming roller such that the container with the lid is capable of being fixed centered between the first seaming roller and the second seaming roller in an operating state; and a first seaming roller drive drive-connected to the first seaming roller and a second seaming roller drive drive-connected to the second seaming roller, the first seaming roller and the second seaming roller configured to be rotated about the seaming head by the first and second seaming roller drives, so that, in the operating state, the first seaming roller and the second seaming roller with the first seaming profile and the second seaming profile are capable of being moved along a circumference of the container immovably fixed by the seaming head, and a container flange of the container can be seamed with a lid flange of the lid.

2. The seaming roller device according to claim 1, wherein the first seaming roller and the second seaming roller are configured to be rotated about a seaming head axis of the seaming head, a container axis of the container capable of being arranged with the seaming head axis in the operating state.

3. The seaming device according to claim 1, wherein the first seaming roller and the second seaming roller are arranged on a seaming roller arrangement and the rotary drive comprises a seaming drive drive-connected to the seaming roller arrangement, the seaming drive configured to rotate the seaming roller arrangement at a first angular speed so that, in the operating state, the first seaming roller and the second seaming roller with the first seaming profile and the second seaming profile are capable of being moved along a circumference of the container immovably fixed by the seaming head.

4. The seaming device according to claim 3, wherein the seaming roller arrangement is arranged around the seaming head and an axis of rotation of the seaming roller arrangement corresponds to a seaming head axis of the seaming head.

5. The seaming device according to claim 1, wherein the first and second seaming roller drives are servo drives.

6. The seaming device according to claim 1, wherein the first seaming roller is configured to be rotated along the first seaming profile and the second seaming roller along the second seaming profile, synchronously and at a fixed angular distance from each other.

7. The seaming device according to claim 1, further comprising a third seaming roller with a third seaming profile and a fourth seaming roller with a fourth seaming profile to seam a container flange of the container with a lid flange of the lid, the seaming head centerably arranged between the third seaming roller and the fourth seaming roller such that the container with the lid is capable of being fixed centered between the third seaming roller and the fourth seaming roller in the operating state, and the third seaming roller and the fourth seaming roller are drive-connected to third and fourth seaming roller drives, respectively, the third seaming roller and the fourth seaming roller configured to be rotated about the seaming head by the third and fourth seaming roller drives, so that, in the operating state, the third seaming roller and the fourth seaming roller with the third seaming profile and the fourth seaming profile are capable of being moved along the circumference of the container immovably fixed by the seaming head, the container flange of the container capable of being seamed with the lid flange of the lid.

8. The seaming device according to claim 7, wherein the first seaming roller and the third seaming roller are pre-seaming rollers configured to form a pre-seam, and the second seaming roller and the fourth seaming roller are finishing seaming rollers configured to form a finishing seam.

9. The seaming device according to claim 1, wherein each of the first and second seaming rollers is drive-connected to the first and second seaming roller drives, respectively via first and second shaft connections, respectively.

10. The seaming device according to claim 9, wherein at least one of the first and second shaft connections comprises an eccentric connection so that the respective first and second seaming roller is arranged eccentrically to an axis of rotation of the respective first and second seaming roller drive.

11. The seaming device according to claim 1, wherein the seaming head comprises a gas supply configured to supply a gas to the container.

12. The seaming device according to claim 1, wherein the seaming head comprises a suction device configured to suck the lid.

13. A method for seaming the container by the corresponding lid, the method comprising:

providing the seaming device according to claim 1;

introducing the container and the lid into the seaming device;

applying the lid to an opening of the container;

immovably fixing the container and the lid by the seaming head centered between the first seaming roller and the second seaming roller; and rotating the first seaming roller and the second seaming roller about the seaming head, so that the first seaming roller and the second seaming roller with the first seaming profile and the second seaming profile are moved along the circumference of the container, the container flange of the container being seamed with the lid flange of the lid.

14. The method according to claim 13, wherein prior to the container and the lid being introduced into the seaming device, a run-out correction of the seaming rollers is carried out by moving the first and second seaming rollers up to the seaming head and rotating the first and second seaming rollers around the seaming bead, and a run-out sensor determines an unevenness in the seaming head or the seaming roller during rotation around the seaming head and corrects the unevenness during sealing of the container by adapting an infeed of the first and second seaming rollers to the seaming head.

15. The method according to claim 13, wherein the lid is aligned in a predeterminable orientation before being applied to the opening of the container.

16. The method according to claim 13, wherein an infeed of the first and second seaming rollers or of the seaming head to the container takes place by feeding the seaming rollers or the seaming head to the container until a predeterminable force is reached and then moving the first and second seaming rollers further to the container over a predeterminable distance.

17. A sealer comprising:

the seaming device according to claim 1; and a container feed.

* * * * *